US006436278B1

(12) United States Patent
Benazzi et al.

(10) Patent No.: US 6,436,278 B1
(45) Date of Patent: Aug. 20, 2002

(54) PROCESS FOR PRODUCING GASOLINE WITH AN IMPROVED OCTANE NUMBER

(75) Inventors: Eric Benazzi, Chatou; Pierre-Henri Bigeard, Vienne; Nathalie Marchal-George, Saint Genis Laval; Tivadar Cseri, Courbevoie, all of (FR)

(73) Assignee: Institut Francais du Petrole (FR)

( * ) Notice: Subject to any disclaimer, the term of this patent is extended or adjusted under 35 U.S.C. 154(b) by 0 days.

(21) Appl. No.: 09/676,992

(22) Filed: Oct. 2, 2000

(30) Foreign Application Priority Data

Sep. 30, 1999 (FR) ..... 99 12337

(51) Int. Cl.[7] ..... C10G 35/04; C10G 35/06; C10G 61/00; C10G 69/02

(52) U.S. Cl. ..... 208/62; 208/66

(58) Field of Search ..... 208/62, 66

(56) References Cited

FOREIGN PATENT DOCUMENTS

| | | | |
|---|---|---|---|
| EP | 0 280 476 | A2 | 8/1988 |
| EP | 0 295 638 | A1 | 12/1988 |
| EP | 0 471 524 | A1 | 2/1992 |
| EP | 0 583 836 | A1 | 2/1994 |

*Primary Examiner*—Walter D. Griffin
*Assistant Examiner*—Tam M. Nguyen
(74) *Attorney, Agent, or Firm*—Millen, White, Zelano & Branigan

(57) ABSTRACT

The invention concerns a process for producing gasoline with an improved octane number, optionally accompanied by oil and/or middle distillate production, by conversion-hydroisomerization of the paraffins in the feed using a catalyst containing at least one noble metal deposited on an amorphous acidic support. Isoparaffins are separated from the gasoline cut obtained, and normal paraffins and possibly monobranched paraffins contained in the resulting effluent are isomerized using a catalyst containing at least one hydrodehydrogenating metal and at least one acidic solid. The ensemble of the streams charged with isoparaffins with an improved octane number is sent to the gasoline pool. The residue undergoes catalytic dewaxing.

24 Claims, 2 Drawing Sheets

Evaluation of catalyst A for conversion-hydroisomerisation of a Fischer-Tropsch feed followed by separation and catalytic dewaxing (test I)

PROCESS FOR PRODUCING GASOLINE WITH AN IMPROVED OCTANE NUMBER

The present invention relates to an improved process for producing gasoline with an improved octane number from hydrocarbon-containing feeds, preferably from hydrocarbon-containing feeds from the Fischer-Tropsch process, with optional simultaneous production of middle distillates (gas oils, kerosine) of very high quality (i.e., with a low pour point and a high cetane index for gas oils) and of oils.

PRIOR ART

The application of increased environmental constraints means that gasoline can no longer contain lead, this is in force in the United States and Japan and is in course of being generalised in Europe. Initially, aromatic constituents, the principal constituents of reformed gasoline, and isoparaffins produced by aliphatic alkylation or isomerisation of light gasolines, compensated for the loss of octane number resulting from removing lead from gasolines.

Subsequently, oxygen-containing compounds such as methyl tertiobutyl ether (MTBE) or ethyl tertiobutyl ether (ETBE) were introduced into gasoline. More recently, the known toxicity of compounds such as aromatic compounds, in particular benzene, olefins and sulphur-containing compounds, and the desire to reduce the vapour pressure of gasoline, have resulted in the production of reformulated gasoline in the United States. As an example, the maximum amounts of olefins, aromatic compounds and benzene in gasoline distributed in California in 1996 were respectively 6% by volume, 25% by volume and 1% by volume. In Europe, the specifications are less severe, however a similar reduction in the maximum amounts of benzene, aromatic compounds and olefins in produced and marketed gasolines are anticipated.

Gasoline pools comprise a number of components. The major components are reformulated gasolines, which normally comprise between 60% and 80% by volume of aromatic compounds, and FCC gasolines which typically contain 35% by volume of aromatic compounds but provide the majority of olefinic and sulphur-containing compounds present in the gasoline pools. The other components can be alkylates, with no aromatic or olefinic compounds, isomerised if at all, or non isomerised light gasolines, which contain no unsaturated compounds, oxygen-containing compounds such as MTBE, and butanes.

Provided that the aromatic compound content is not reduced below 35–40% by volume, the contribution of reformates to the gasoline pool remains high, typically 40% by volume. In contrast, an increased restriction to the maximum admissible amount of aromatic compounds to 20–25% by volume would cause a reduction in the use of reforming, and as a result the need to upgrade cuts composed of paraffins which are slightly or not isomerised, if at all, and with boiling points which correspond those of a gasoline cut, by routes other than reforming.

To this end, the production of multibranched isomers from slightly branched paraffins (contained in the gasoline cuts) instead of the production of toluene and xylenes, for example from naphthas, appears to be an extremely promising route. This forms the reasoning behind the search for high performance catalytic systems for isomerising paraffins (also known as hydroisomerisation when carried out in the presence of hydrogen), and more generally gasoline cuts, and for the search for processes allowing selective recycling of low octane number compounds, namely straight chain and monobranched paraffins, to the isomerisation step (hydroisomerisation step).

Adsorption and permeation separation techniques are particularly suitable for separating straight chain, monobranched and multibranched paraffins.

Conventional adsorption separation processes can be based on carrying out PSA (pressure swing adsorption), TSA (temperature swing adsorption), chromatographic (elution or simulated counter-current chromatography, for example) type processes. They can also be based on a combination of these implementations. The common factor in all of those processes is that a liquid or gaseous mixture is brought into contact with a fixed bed of adsorbent to eliminate certain constituents of the mixture which may be adsorbed. Desorption may be carried out in different ways.

The common characteristic of PSA type processes is regeneration of the bed by depressurisation and in some cases by low pressure flushing. PSA type processes have been described in U.S. Pat. No. 3,430,418 by Wagner or in the more general work by Yang ("Gas separation by adsorption processes", Butterworth, US, 1987).

TSA processes, which use temperature as the driving force for desorption, are the first processes to have been developed for adsorption. The bed to be regenerated is heated by circulating a pre-heated gas in an open or closed loop in the reverse direction to that of the adsorption step. Numerous variations of schemes ("Gas separation by adsorption processes", Butterworth, US, 1987) are used depending on local constraints and the nature of the gas employed.

Gas or liquid chromatography is a highly effective separation technique since it employs a very large number of theoretical plates (Ind. Eng. Chem. Prod. Res. Develop., 1979, 18, 263). It can thus employ relatively low adsorption selectivities and difficult separations can be carried out. Such processes are in fierce competition with continuous simulated moving bed or simulated counter current processes, which have been developed to a sophisticated degree in the petroleum industry. The use of such adsorption processes in the field of gasoline production is well known. However, such processes are always applied to the light $C_5$–$C_6$ fraction with the aim of improving the octane number.

Permeation separation techniques have the advantage over adsorption separation techniques of being continuous and as a result of being relatively simple to carry out. Further, they are recognised for their modular nature and compactness. About ten years ago, they took their place beside gas adsorption and separation techniques, for example for recovering hydrogen from refinery gases, decarbonising natural gasoline and producing inerting nitrogen ("Handbook of Industrial Membranes", Elsevier Science Publishers, UK, 1995).

Regarding catalytic paraffin isomerisation systems, a compromise can be reached between isomerisation proper and acid cracking or hydrogenolysis, which produce light $C_1$–$C_4$ hydrocarbons and which drop the global yields. Thus the more branched the paraffin, the easier it isomerises, but the greater its propensity for cracking. This justifies the search for more selective catalysts and for processes arranged so as to supply different isomerisation sections with streams which are rich in straight chain paraffins or monobranched paraffins.

AIM OF THE INVENTION

The Applicant has directed its research towards developing an improved process for producing gasolines with an improved octane number, generally accompanied by the production of middle distillates with a high cetane index and the production of very high quality oils (the oils obtained have a high viscosity index (VI), low volatility, good UV stability and a low pour point) from petroleum cuts, preferably from hydrocarbon-containing feeds from the Fischer-Tropsch process, or feeds from hydrocracking vacuum distillates, that is to say, hydrocracking residues in general.

The invention describes a process for producing gasoline with an improved octane number from a hydrocarbon-containing feed, comprising the following successive steps:

(a) converting the feed with simultaneous hydroisomerisation of the paraffins of the feed, said feed having a sulphur content of less than 1000 ppm by weight, a nitrogen content of less than 200 ppm by weight, a metals content of less than 50 ppm by weight, an oxygen content of at most 0.2% by weight, said step being carried out at a temperature of 200–500° C., at a pressure of 5–25 MPa, with a space velocity of 0.1–5 $h^{-1}$, in the presence of hydrogen, and in the presence of a catalyst containing at least one noble metal deposited on an amorphous acidic support and separating at least one gasoline cut and at least one residue containing compounds with a boiling point of more than at least 340° C. from the effluent from step a);

(b) separating iso-paraffins from said gasoline cut from step a), and producing an effluent containing normal paraffins;

(c) isomerising the paraffins of at least a portion of said effluent by contact with a catalyst containing at least one hydrodehydrogenating metal and at least one acidic solid, in the presence of hydrogen, so as to produce an effluent charged with iso-paraffins with an improved octane number;

(b') catalytic dewaxing of said residue using a catalyst comprising at least one molecular sieve wherein the microporous system exhibits at least one principal channel type with pore openings having 9 or 10 T atoms, T being selected from the group formed by Si, Al, P, B, Ti, Fe, Ga, alternating with an equal number of oxygen atoms, the distance between two accessible pore openings having 9 or 10 T atoms being at most 0.75 nm, and said sieve having a 2-methylnonane/5-methylnonane ratio of more than 5 in the n-decane test.

Step a) is optionally preceded by a hydrotreatment step generally carried out at a temperature of 200–450° C., at a pressure of 2 to 25 MPa, at a space velocity of 0.1–6 $h^{-1}$, in the presence hydrogen in a hydrogen/hydrocarbon volume ratio of 100–2000 l/l, and in the presence of an amorphous catalyst comprising at least one group VIII metal and at least one group VIB metal.

Step a) is advantageously followed by separating light gaseous compounds from the effluent obtained at the end of step a).

Preferably, the effluent from the hydroisomerisation treatment undergoes a distillation step (preferably atmospheric) to separate gas, gasoline, kerosine, gas oil, i.e., compounds with a boiling point of less than 340° C., the remaining products having an initial boiling point of more than at least 340° C. and forming the residue. Thus at least one gasoline fraction with boiling points in the range from those of hydrocarbon compounds containing 5 carbon atoms to about 180° C., or even 150° C. depending on the case are separated and also in general, at least one middle distillate fraction which advantageously has a pour point of at most −20° C. and a cetane index of at least 50.

In a preferred variation of the process, catalytic dewaxing step b') is applied to the residue from the distillation step which contains compounds with a boiling point of more than at least 340° C. In a further implementation of the invention, the effluent from step a) is not distilled before carrying out this step. At most, at least a portion of the light gases is separated (by flash . . . ) and it then undergoes catalytic dewaxing.

Preferably, this catalytic dewaxing step is carried out using a catalyst containing at least one molecular sieve wherein the microporous system has at least one principal channel type with a pore opening containing 9 or 10 T atoms, T being selected from the group formed by Si, Al, P, B, Ti, Fe, Ga, alternating with an equal number of oxygen atoms, the distance between two accessible pore openings containing 9 or 10 T atoms being at most 0.75 mm, and said sieve having a 2-methylnonane/5-methylnonane ratio of more than 5 in the n-decane test.

Advantageously, the effluent from the dewaxing treatment undergoes a distillation step advantageously comprising atmospheric distillation and vacuum distillation so as to separate at least one oil fraction with a boiling point of more than at least 340° C. It usually has a pour point of less than −10° C., and a VI of more than 95, with a viscosity of at least 3 cSt (i.e., 3 $mm^2/s$) at 100° C.

DETAILED DESCRIPTION OF THE INVENTION

The process of the invention comprises the following steps:

The Feed

The hydrocarbon feed for the production of gasoline has an initial boiling point which is at least equal to that of the gasoline. Usually, the feed has an initial boiling point of at least 80° C. and generally at least 150° C. When the process is also aimed at producing oils and optional production of high quality middle distillates, the hydrocarbon feed preferably contains at least 20% by volume of compounds boiling above 340° C., preferably at least 350° C. and advantageously at least 380° C. This does not means that the boiling point is 380° C. and higher, but 380° C. or higher.

The feed contains n-paraffins and/or slightly branched paraffins (monobranched paraffins). Preferably, the feed is an effluent from a Fischer-Tropsch unit. A wide variety of feeds can be treated using the process.

The feed can, for example, also be a vacuum distillate from straight run crude distillation or from conversion units such as FCC, a coker or from visbreaking, or from aromatic compound extraction units, or originating from AR (atmospheric residue) and/or VR (vacuum residues) desulphurisation or hydroconversion, or the feed can be a deasphalted oil, or a hydrocracking residue, for example from VD (vacuum distillation), or any mixture of the feeds cited above. The above list is not limiting.

In general, suitable feeds for the joint production of oils have an initial boiling point of more than at least 340° C., preferably more than at least 370° C., but they are entirely suitable for the production of gasoline with an improved octane number.

The feed introduced into conversion-hydroisomerisation step a) must be clean. The term "clean feed" means feeds in which the sulphur content is less than 1000 ppm by weight, preferably less than 500 ppm by weight, more preferably less than 300 ppm by weight or still more preferably less than 100 ppm by weight. The nitrogen content is less than 200 ppm by weight, preferably less than 100 ppm by weight, more preferably less than 50 ppm by weight. The metals content in the feed, such as nickel or vanadium, is extremely reduced, i.e., less than 50 ppm by weight, more advantageously less than 10 ppm by weight, or preferably less than 2 ppm by weight.

When the amounts of unsaturated or oxygen-containing products can cause too great a deactivation of the catalytic system, the feed (for example from the Fischer-Tropsch process) must undergo hydrotreatment in a hydrotreatment zone before entering the hydroisomerisation zone. Hydrogen is reacted with the feed in contact with a hydrotreatment catalyst the role of which is to reduce the amount of unsaturated and oxygen-containing hydrocarbon molecules (produced, for example, during the Fischer-Tropsch process).

The oxygen content is then reduced to at most 0.2% by weight.

When the feed to be treated is not clean in the sense defined above, it first undergoes a prior hydrotreatment step during which it is brought into contact, in the presence of hydrogen, with at least one catalyst comprising an amorphous support and at least one metal with a hydrodehydrogenating function ensured, for example, by at least one group VIB and at least one group VIII element, at a temperature in the range 200° C. to 450° C., preferably 250° C.–450° C., advantageously 330–450° C. or 360–420° C., at a pressure in the range 5 to 25 MPa and preferably less than 20 MPa, preferably in the range 5 to 20 MPa, the space velocity being in the range 0.1 to 6 $h^{-1}$, preferably 0.3–3 $h^{-1}$, and the quantity of hydrogen introduced being such that the hydrogen/hydrocarbon volume ratio is in the range 100 to 2000 litres/litre.

The support is generally based on (and preferably is essentially constituted by) amorphous alumina or silica-alumina; it can also comprise boron oxide, magnesia, zirconia, titanium oxide or a combination of these oxides. The hydro-dehydrogenating function is preferably fulfilled by at least to one metal or compound of a metal from groups VIII and VIB, preferably selected from molybdenum, tungsten, nickel and cobalt.

This catalyst can advantageously contain phosphorous; this compound is known in the prior art to have two advantages for hydrotreatment catalysts: facility of preparation, in particular when impregnating with nickel and molybdenum solutions, and better hydrogenation activity.

Preferred catalysts are NiMo and/or NiW on alumina catalysts, as well as NiMo and/or NiW on alumina catalysts doped with at least one element selected from the group formed by phosphorous, boron, silicon and fluorine, or NiMo and/or NiW on silica-alumina catalysts, or on silica-alumina-titanium oxide doped or not doped with at least one element selected from the group formed by phosphorous, boron, fluorine and silicon atoms.

The total concentration of oxides of group VIB and VIII metals is in the range 5% to 40% by weight, preferably in the range 7% to 30% and the weight ratio, expressed as the metal oxide, of the group VI metal (or metals) to the group VIII metal (or metals) is preferably in the range 20 to 1.25, more preferably in the range 10 to 2. The concentration of phosphorous oxide $P_2O_5$ is less than 15% by weight, preferably less than 10% by weight.

Before being sent to step a), if necessary, intermediate separation of water ($H_2O$, $H_2S$ and $NH_3$) is carried out on the product obtained at the end of the hydrotreatment step to bring the water, $H_2S$ and $NH_3$ contents to values of less than at most 100 ppm, 200 ppm, 50 ppm respectively in the feed introduced into step a). At this point, the products with a boiling point of less than 340° C. or the gasoline fraction with a boiling point generally of at most about 180° C. or less than 180° C. can optionally be separated.

Step a): Hydroisomerisation-conversion

The Catalyst

Step a) takes place in the presence of hydrogen and in the presence of a bifunctional catalyst comprising an amorphous acidic support (preferably an amorphous silica-alumina) and a metallic hydrodehydrogenating function ensured by at least one noble metal.

The support is said to be amorphous, i.e., free of molecular sieve, in particular zeolite; the catalyst too is amorphous. The amorphous acidic support is advantageously an amorphous silica-alumina but other supports are suitable. When a silica-alumina is used, the catalyst generally contains no added halogen apart from that which can be introduced for impregnation, for example a noble metal.

During this step the long n-paraffins, in the presence of a bifunctional catalyst, undergo isomerisation then possibly hydrocracking to result respectively in the formation of isoparaffins and cracking products which are lighter than gas oils and kerosine. Conversion is generally in the range 5% to 90% but is generally at least 20% or more than 20%.

In a preferred implementation of the invention, a catalyst comprising a particular silica-alumina is used which can produce very active catalysts which are also highly selective for isomerising feeds such as those defined above.

More precisely, the preferred catalyst comprises (and is preferably essentially constituted by) 0.05% to 10% by weight of at least one noble metal from group VIII deposited on an amorphous silica-alumina support (preferably containing 5–70% by weight of silica) with a BET specific surface area of 100–500 $m^2/g$, and the catalyst exhibits:

- a mean mesopore diameter in the range 1–12 nm;
- a pore volume of pores with a diameter in the range from the mean diameter as defined above less 3 nm to the mean diameter as defined above plus 3 nm of more than 40% of the total pore volume;
- a dispersion of noble metal in the range 20–100%;
- a noble metal distribution coefficient of more than 0.1.

In more detail, the catalyst characteristics are as follows:

Silica Content

The preferred support used to produce the catalyst described in the present patent is composed of silica $SiO_2$ and alumina $Al_2O_3$. The silica content of the support, expressed as a percentage by weight, is generally in the range 1% to 95%, advantageously in the range 5% to 95%, more preferably in the range 10% to 80% and still more preferably in the range 20% to 70%, or even 22% to 45%. This silica content can be accurately measured using X ray fluorescence.

Nature of Noble Metal

For this particular type of reaction, the metallic function is provided by a noble metal from group VIII of the periodic table, more particularly platinum and/or palladium.

Noble Metal Content

The noble metal content, expressed as the % by weight of metal with respect to the catalyst, is in the range 0.05% to 10%, more preferably in the range 0.1% to 5%.

Noble Metal Dispersion

The dispersion, representing the fraction of metal accessible to the reactant with respect to the total quantity of the metal of the catalyst, can be measured by $H_2/O_2$ titration, for example. The metal is first reduced, i.e., it undergoes a treatment in a stream of hydrogen at a high temperature under conditions such that all of the platinum atoms which are accessible to hydrogen are transformed into the metal form. Then a stream of oxygen is passed under operating conditions which are such that all of the reduced platinum atoms accessible to the oxygen are oxidised to the $PtO_2$ form. By calculating the difference between the quantity of oxygen introduced and the quantity of oxygen leaving, the quantity of oxygen consumed can be determined. This latter value can be used to deduce the quantity of platinum which is accessible to oxygen. The dispersion is then equal to the ratio of the quantity of platinum accessible to oxygen over the total quantity of platinum of the catalyst. In our case, the dispersion is in the range 20% to 100% and preferably in the range 30% to 100%.

Distribution of Noble Metal in the Grain

The noble metal distribution represents the distribution of the metal inside the catalyst grain, the metal being well or poorly dispersed. Thus it is possible to obtain platinum which is poorly distributed (for example detected in a crown the thickness of which is substantially less than the grain radius) but well dispersed, i.e., all of the platinum atoms situated in the crown are accessible to the reactants. In our case, the platinum distribution is good, i.e., the platinum profile, measured using a Castaing microprobe method, has a distribution coefficient of more than 0.1, preferably more than 0.2.

BET Surface Area

The BET surface area of the support is generally in the range 100 $m^2/g$ to 500 $m^2/g$, preferably in the range 250 $m^2/g$ to 450 $m^2/g$, and for silica-alumina based supports, more preferably in the range 310 $m^2/g$ to 450 $m^2/g$.

Mean Pore Diameter

For the preferred silica-alumina based catalysts, the mean pore diameter of the catalyst is measured from the pore distribution profile obtained using a mercury porosimeter. The mean pore diameter is defined as the diameter corresponding to that where the derivative of the curve obtained from the mercury porosity curve reduces to zero. The mean pore diameter thus defined is in the range 1 nm ($1\times10^{-9}$ meters) to 12 nm ($12\times10^{-9}$ meters) and preferably in the range 1 nm ($1\times10^{-9}$ meters) to 11 nm ($11\times10^{-9}$ meters), still more preferably in the range 3 nm ($4\times10^{-9}$ meters) to 10.5 nm ($10.5\times10^{-9}$ meters).

Pore Distribution

The pore distribution of the preferred catalyst of this patent is such that the pore volume of pores with a diameter in the range from the mean diameter as defined above reduced by 3 nm to the mean diameter as defined above increased by 3 nm (i.e., the mean diameter±3 nm) is more than 40% of the total pore volume, preferably in the range 50% to 70% of the total pore volume.

Global Pore Volume of Support

For the preferred silica-alumina based catalyst, this is generally less than 1.0 ml/g, preferably in the range 0.3 to 0.9 ml/g, and more advantageously less than 0.85 ml/g.

The support, especially the silica-alumina (in particular used in the preferred implementation) is prepared and formed using the usual methods which are well known to the skilled person. Advantageously, prior to impregnating the metal, the support is calcined, for example by a heat treatment at 300–750° C. (preferably 600° C.) for a period in the range 0.25 to 10 hours (preferably 2 hours) in 0–30% by volume of steam (preferably about 7.5% for a silica-alumina matrix).

The metal salt is introduced using one of the usual methods for depositing a metal (preferably platinum and/or palladium, platinum being more preferred) on the surface of a support. One preferred method is dry impregnation which consists of introducing the metal salt into a volume of solution which is equal to the pore volume of the catalyst mass to be impregnated. Before the reduction operation, the catalyst can be calcined, for example in dry air at 300–750° C. (preferably 520° C.) for 0.25–10 hours (preferably 2 hours).

In a further preferred implementation of the invention, step a) takes place in the presence of hydrogen and in the presence of a bifunctional catalyst comprising at least one noble metal deposited on an amorphous acidic support, the dispersion of the noble metal being less than 20%.

Preferably, the fraction of noble metal particles with a size of less than 2 nm represents at most 2% by weight of the noble metal deposited on the catalyst.

Advantageously, the size of at least 70% (preferably at least 80% and more preferably at least 90%) of the noble metal particles is over 4 nm (number %).

The support is amorphous and contains no molecular sieve; the catalyst also contains no molecular sieve.

The amorphous acidic support is generally selected from the group formed by a silica-alumina, a halogenated (preferably fluorinated) alumina, an alumina doped with silica (deposited silica), an alumina—titanium oxide mixture, a sulphated zirconia, a zirconia doped with tungsten, and mixtures thereof or with at least one amorphous matrix selected from the group formed by alumina, titanium oxide, silica, boron oxide, magnesia, zirconia and clay, for example. Preferably, the support is constituted by an amorphous silica alumina.

A preferred catalyst of the invention comprises (and preferably is essentially constituted by) 0.05% to 10% by weight of at least one group VIII noble metal deposited on an amorphous silica-alumina support.

In more detail, the catalyst characteristics are as follows:

Silica Content

The preferred support used to produce the catalyst described in the present patent is composed of silica $SiO_2$ and alumina $Al_2O_3$ from synthesis. The silica content of the support, expressed as a percentage by weight, is generally in the range 1% to 95%, advantageously in the range 5% to 95%, more preferably in the range 10% to 80% and still more preferably in the range 20% to 70%, or even 22% to 45%. This silica content can be accurately measured using X ray fluorescence.

Nature of Noble Metal

For this particular type of reaction, the metallic function is provided by a noble metal from group VIII of the periodic table, more particularly platinum and/or palladium.

Noble Metal Content

The noble metal content, expressed as the % by weight of metal with respect to the catalyst, is in the range 0.05% to 10%, more preferably in the range 0.1% to 5%.

Noble Metal Dispersion

The dispersion, representing the fraction of metal accessible to the reactant with respect to the total quantity of the metal of the catalyst, can be measured by $H_2/O_2$ titration, for example. The metal is first reduced, i.e., it undergoes a treatment in a stream of hydrogen at a high temperature under conditions such that all of the platinum atoms which are accessible to hydrogen are transformed into the metal form. Then a stream of oxygen is passed under operating conditions which are such that all of the reduced platinum atoms accessible to the oxygen are oxidised to the $PtO_2$ form. By calculating the difference between the quantity of oxygen introduced and the quantity of oxygen leaving, the quantity of oxygen consumed can be determined. This latter value can be used to deduce the quantity of platinum which is accessible to the oxygen. The dispersion is then equal to the ratio of the quantity of platinum accessibleto oxygen over the total quantity of platinum of the catalyst. In our case, the dispersion is less than 20%; and generally more than 1% or preferably 5%.

Particle Size Measured by Transmission Electron Microscopy

In order to determine the size and distribution of the metal particles, we used a transmission electron microscope. After preparation, the catalyst sample is finely ground in an agate mortar then dispersed in ethanol using ultrasound. Samples taken from different locations to ensure good size representation are deposited onto a copper grid coated with a thin carbon film. The grids are then dried in air under an infrared lamp before being introduced into the microscope for observation. In order to estimate the average size of the noble metal particles, several hundred measurements are made from several tens of photographs. This set of measurements produces a particle size distribution histogram. Thus we can precisely estimate the proportion of particles corresponding to each particle size range.

Distribution of Noble Metal

The noble metal distribution represents the distribution of the metal inside the catalyst grain, the metal being well or poorly dispersed. Thus it is possible to obtain platinum which is poorly distributed (for example detected in a crown the thickness of which is substantially less than the grain radius) but well dispersed, i.e., all of the platinum atoms situated in the crown are accessible to the reactants. In our case, the platinum distribution is good, i.e., the platinum profile, measured using a Castaing microprobe method, has a distribution coefficient of more than 0.1, preferably more than 0.2 and more preferably more than 0.5.

BET Surface Area

The BET surface area of the support is generally in the range 100 $m^2/g$ to 500 $m^2/g$, preferably in the range 250 $m^2/g$ to 450 $m^2/g$, and for silica-alumina based supports, more preferably 310 $m^2/g$.

Global Pore Volume of Support

For the preferred silica-alumina based catalyst, this is generally less than 1.2 ml/g, preferably in the range 0.3 to 1.1 ml/g, and more advantageously less than 1.05 ml/g.

The silica-alumina and in general any support is prepared and formed using the usual methods which are well known to the skilled person. Advantageously, prior to impregnating the metal, the support is calcined, for example by a heat treatment at 300–750° C. (preferably 600° C.) for a period in the range 0.25 to 10 hours (preferably 2 hours) in 0–30% by volume of steam (preferably about 7.5% for a silica-alumina).

The metal salt is introduced using one of the usual methods for depositing a metal (preferably platinum) on the surface of a support. One preferred method is dry impregnation which consists of introducing the metal salt into a volume of solution which is equal to the pore volume of the catalyst mass to be impregnated. Before the reduction operation, the catalyst can be calcined, for example in moist air at 300–750° C. (preferably 550° C.) for 0.25–10 hours (preferably 2 hours). The partial pressure of $H_2O$ during calcining is, for example, 0.05 bars to 0.50 bars (preferably 0.25 bars). Other known treatment methods can produce a dispersion of less than 20% which is suitable for the invention.

After preparation (for example as described in the above implementations), and before use in the conversion reaction, the metal contained in the catalyst must be reduced. One preferred method for reducing the metal is a treatment in hydrogen at a temperature in the range 150° C. to 650° C. and at a total pressure in the range 0.1 to 25 MPa. As an example, reduction consists of a constant temperature stage at 150° C. for 2 hours then raising the temperature to 450° C. at a rate of 1° C./min followed by a constant temperature stage of 2 hours at 450° C.; during the whole of this reduction step, the hydrogen flow rate is 1000 l of hydrogen/l of catalyst. It should also be noted that any ex-situ reduction method is suitable.

The operating conditions under which this second step a) is carried out are important.

The pressure is generally in the range 2 to 25 MPa, preferably 2 (or 3) to 20 MPa and advantageously 2 to 18 MPa; the hourly space velocity is in the range 0.1 $h^{-1}$ to 10 $h^{-1}$, preferably in the range 0.2 to 10 $h^{-1}$ and advantageously in the range 0.1 or 0.5 $h^{-1}$ to 5.0 $h^{-1}$. The hydrogen rat is advantageously in the range 100 to 2000 litres of hydrogen per litre of feed and preferably in the range 150 to 1500 litres of hydrogen per litre of feed.

The temperature used in this step is usually in the range 200° C. to 450° C. and preferably in the range 250° C. to 450° C., advantageously in the range 300° C. to 450° C. and more advantageously more than 320° C., for example in the range 320–450° C.

This conversion step a) is usually accompanied by paraffin hydroisomerisation. The process has the advantage of flexibility: depending on the degree of conversion, the production is more directed towards oils or middle distillates or gasoline. Conversion also varies between 5% and 90%.

The two steps of hydrotreatment and conversion can be carried out using two types of catalysts in a plurality (two or more) of different reactors, and/or using at least two catalytic beds installed in the same reactor.

Treatment of Effluent From Step a)

At least a portion (and preferably at least the major portion) of the light gases which comprise hydrogen, possibly ammonia and hydrogen sulphide which may be formed, and possibly also compounds containing more than 4 carbon atoms can be separated from the effluent from conversion step a). Hydrogen can be separated in advance.

Advantageously, the effluent is distilled to separate the light gases and also to separate at least one gasoline fraction. Advantageously too, a residue containing compounds with a boiling point of more than at least 340° C. can be separated. Preferably, atmospheric distillation is carried out.

Advantageously, distillation can be carried out to obtain a plurality of fractions (gasoline, kerosine, gas oil, for example) with a boiling point of at most 340° C. and a fraction (residue) with an initial boiling point of more than at least 340° C. and preferably more than 350° C., more preferably at least 370° C. or 380° C.

In a preferred variation of the invention, this fraction (residue) is then treated in a catalytic dewaxing step, i.e., without undergoing vacuum distillation. However in a still further variation, vacuum distillation can be carried out.

In an implementation which is more closely directed towards producing middle distillates and gasolines, and in accordance with the invention, a portion of the residue from the separation step can be recycled to the reactor containing the hydroisomerisation catalyst b) to convert it and increase the production of middle distillates and gasolines.

In general, the term "middle distillates" as used in this text is applied to fraction(s) with an initial boiling point which is above the end point of the gasoline, i.e., generally at least about 150° C. or more than 150° C., and an end point of just before the residue, i.e., generally up to 340° C., 350° C., or preferably less than 370° C. or 380° C.

Before or after distillation, the effluent from step a) can undergo other treatments such as extraction of at least a portion of the aromatic compounds.

This effluent does not in general undergo a conversion treatment.

Step b): Separation of Isoparaffins from Gasoline Cut

Multibranched paraffins (di- and more) have the best octane numbers. Thus the gasoline cut (for example from atmospheric distillation) undergoes one or more separation steps which separate n-paraffins from the isoparaffins and/or separates the individual isoparaffins.

These separation operations can be carried out in the liquid phase or in the gas phase using processes employing adsorbents and/or membranes. The adsorption separation processes used can, for example, be of the PSA (pressure swing adsorption), TSA (temperature swing adsorption), or chromatographic type (elution or simulated counter-current chromatography, for example) or result from a combination of these implementations. The separating units can use one or more molecular sieves. Further, generally a plurality of separation units (two to six) are used in parallel and in alternation to produce a process functioning continuously even though adsorption processes are by nature discontinuous. When separation is by permeation, the isomerate (isomerised paraffins) can be separated using a gas permeation or pervaporation technique.

Advantageously, the process comprises at least two units which can function using an adsorbent or membrane. Preferably, the process uses a combination of at least one unit functioning by adsorption with the aim of carrying out one of the separation steps and at least one membrane unit to carry out the other separation step of the invention.

When separation is carried out by adsorption, at least one natural or synthetic adsorbent is used which can separate:

straight chain paraffins from monobranched, multibranched paraffins;

or these same straight chain paraffins from monobranched paraffins;

or multibranched paraffins from monobranched paraffins.

Separation using such adsorbents is carried out on the basis of differences between the geometrical, diffusional or thermodynamic properties of the adsorbing material in the adsorbents under consideration. A larger number of adsorbent materials are available to carry out this type of separation. They include carbon molecular sieves, activated clays, silica gel, activated alumina and crystalline molecular sieves. These latter have a uniform pore size and are thus particularly suitable for two types of separation. These molecular sieves include the different forms of silicoaluminophosphates and aluminophosphates described in U.S. Pat. Nos. 4,444,871, 4,310,440 and 4,567,027 and zeolitic molecular sieves. In their calcined form, they can be represented by their chemical formula:

$$M_{2/n}O:Al_2O_3:x\ SiO_2:y\ H_2O$$

Where M is a cation, x is in the range 2 to infinity, the value of y is in the range 2 to 10 and n is the valency of the cation.

Within the context of separating straight chain paraffins, or separating these same straight chain paraffins from monobranched paraffins, adsorbents with a pore size which is sufficient to allow adsorption of straight chain paraffins and exclude larger sized molecules such as monobranched paraffins and multibranched paraffins are used. Particularly suitable zeolites are type A zeolites described in U.S. Pat. No. 2,882,243 which in the majority of their exchanged cationic forms, in particular in the calcium form, have a pore diameter of the order of 5 Å (0.5 nm) and have large capacities to adsorb straight chain paraffins. The term "pore diameter" is a conventional term in the art. It is used to define the pore size in a functional manner in terms of the size of molecule which is capable of entering the pore. It does not designate the actual dimensions of the pore as this is often difficult to determine since it is often irregular in shape (i.e., non circular). D. W. Breck provides a discussion regarding the effective pore diameter in the book entitled "Zeolite Molecular Sieves" (John Wiley and Sons, New York, 1974), pages 633 to 341. Other molecular sieves include R zeolite (U.S. Pat. No. 3,030,181), T zeolite (U.S. Pat. No. 2,950,952), silicoaluminophosphates (U.S. Pat. Nos. 4,440,871, 4,310,440 and 4,567,027), and natural zeolites such as clinoptilotite, chabazite and erionite which are suitable for separating straight chain paraffins from monobranched and multibranched paraffins or for separating straight chain paraffins from monobranched paraffins. Finally, the use of a molecular sieve such as ferrierite (U.S. Pat. Nos. 4,804,802 and 4,717,784), ZSM-5 zeolites (U.S. Pat. No. 3,702,886), ZSM-11 (U.S. No. 4,108,881), ZSM-23 (U.S. Pat. No. 4,076,842) and ZSM-35 (U.S. Pat. No. 4,016,245) and silicalite (U.S. Pat. No. 5,055,633) is also entirely suitable for the separations described above since the different diffusional properties of the isomers in them can be exploited. The adsorption details for straight chain paraffins on each of these sieves is known to the skilled person and thus will not be discussed in any further detail.

In the context of adsorbing either monobranched paraffins from a stream rich in mono- and multibranched paraffins or monobranched and straight chain paraffins from a feed, it is preferable to use microporous molecular sieves with an effective pore diameter of slightly more than 5 Å. These include those with elliptical pore cross sections with dimensions in the range 5.0 to 5.5 Å along the minor axis and about 5.5 to 6.0 Å along the major axis. An adsorbent with these characteristics and which is particularly suitable for the present invention is silicalite. The term "silicalite" as used here includes both silicopolymorphs described in U.S. Pat. No. 4,061,724 and F silicalite described in U.S. Pat. No. 4,073,865. Other adsorbents with the same characteristics and as a result are particularly suitable for the present application are ZSM-5, ZSM-11, ZSM-35 (U.S. Pat. No. 4,016,245), ZSM-48 and numerous other analogous crystalline aluminosilicates. ZSM-5 and ZSM-11 are described in U.S. Pat. Nos. 3,702,886, Re 29,948 and 3,709,979. The amount of silica in these adsorbents can vary widely. The most suitable adsorbents for this type of separation are those with high silica contents. The Si/Al mole ratio is preferably at least 10 and more preferably more than 100. A further type of adsorbent which is particularly suitable for our application has pores with an elliptical cross section with dimensions in the range 4.5 to 5.5 Å. This type of adsorbent has been characterized, for example, in U.S. Pat. No. 4,717,748 as being a tectosilicate with pores of a size intermediate between those of a 5A calcium molecular sieve and those of ZSM-5 zeolite. Preferred adsorbents in this family include ZSM-23, described in U.S. Pat. No. 4,076,872, and ferrierite, described in U.S. Pat. Nos. 4,016,425 and 4,251,499.

The pore sizes of these various adsorbents are such that each of the isomers of the $C_5$–$C_8$ or intermediate cuts can be adsorbed. The diffusion kinetics of these isomers is, however, sufficiently different to be exploited. Under certain conditions of use, these molecular sieves can effect the desired separations.

When one of the separation units functions using a permeation technique, the membrane used can take the form of hollow fibres, bundles of tubes or a stack of plates. These configurations are known in the art, and can ensure a homogeneous distribution of fluid to be separated over the whole surface of the membrane, to maintain a pressure difference either side of the membrane, to separately recover fluid which has permeated and fluid which has not permeated. The selective layer can be produced using one of the adsorbent materials described above which may constitute a uniform surface delimiting a zone in which at least a portion of the feed can be circulated, and a zone in which at least a portion of the fluid which has permeated is circulated.

The selective layer can be deposited on a permeable support providing the membrane thus constituted with mechanical strength, as described, for example, in International patent applications WO-A-96/01687 and WO-A-93/19840.

Preferably, the selective layer is produced by growing the zeolite crystals from a microporous support, as described in European patent applications EP-A-0 778 075 and EP-A-0 778 076.

In a preferred implementation of the invention, the membrane is constituted by a continuous layer of silicalite crystals about 40 microns thick, bonded to an alpha alumina support with a porosity of 200 nm.

The operating conditions are selected so as to maintain a difference in the chemical potential of the constituents to be separated over the whole membrane surface to encourage their transfer across the membrane. The pressures either side of the membrane must be such as to produce average transmembrane partial pressure differences for the constituents to be separated of 0.05 to 1.0 MPa.

To reduce the partial pressure of the constituents, it is possible to use a flushing gas or to maintain the vacuum using a vacuum pump at a pressure which, depending on the constituents, can vary from 100 to $10^4$ Pa and to condense the vapours at very low temperature, typically at about −40° C. Depending on the hydrocarbons used, the temperatures must not exceed 200° C. to 400° C. to limit the cracking and/or coking reactions of the olefinic and/or aromatic hydrocarbons in contact with the membrane. Preferably, the rate of circulating the feed must be such that its flow is turbulent.

The operating conditions for the separation units depend on their implementation, the adsorbent or the membrane under consideration, and on the separation to be carried out. The temperature is in the range 50° C. to 450° C. and the pressure is 0.01 to 7 MPa. More precisely, if separation is carried out in the liquid phase, the separation conditions are: a temperature of 50° C. to 200° C. and a pressure of 0.1 to 7 MPa. If said separation is carried out in the gas phase, the conditions are: a temperature of 150° C. to 450° C. and a pressure of 0.01 to 7 MPa.

One or more separations are required depending on the desired octane index and depending on the feeds treated.

It is thus possible to carry out a first separation to obtain n-paraffins and a stream containing isoparaffins (mono+multi) then to carry out a second separation to obtain a stream of monoparaffins and a stream of multi (di and more) paraffins.

The reverse order of separation is possible, i.e., carrying out the second separation (mono-separated from multibranched) before the first separation (n-paraffin separation).

The separated isoparaffins are sent directly to the gasoline pool.

Step c): Paraffin Isomerisation

The effluent from isoparaffin separation step b) and containing short chain normal paraffins and possibly multibranched paraffins with a low octane number is treated in an isomerisation step.

The treatment is carried out using a catalyst with an acidic function and/or a hydrodehydrogenating function and in the presence of hydrogen. These catalysts contain at least one hydrodehydrogenating metal (preferably from group VIII and preferably platinum) and at least one acidic solid. This acidic solid can be a halogenated alumina, preferably a chlorinated alumina, which functions at medium temperatures, between 70° C. and 190° C., a zeolitic molecular sieve such as mordenite, mazzite, ZSM-22 zeolite or beta zeolite. Their operating temperature is higher and is in the range about 180° C. to 280° C. Non zeolitic molecular sieves can also be used, such as silicoaluminophosphates (SAPO-11, SAPO-41 . . . ), and clays such as bridged 2:1 dioctahedral phyllosilicates.

More generally, step c) is carried out in the presence of a catalyst from the bifunctional catalyst family, such as platinum based catalysts or catalysts based on a sulphide phase on an acidic support (chlorinated alumina, zeolite such as mordenite, SAPO, Y zeolite, B zeolite) or from the family of monofunctional acidic catalysts such as chlorinated aluminas, sulphated zirconias with or without platinum and promoter, heteropolyacids based on phosphorous and tungsten, molybdenum oxycarbides and oxynitrides which are normally found among monofunctional catalysts with a metallic nature. They function in a temperature range in the range 25° C. for the most acidic thereof (heteropolyanions, supported acids) to 450° C. for bifunctional catalysts or molybdenum oxycarbides. Chlorinated aluminas are preferably used at 80° C. to 110° C., and platinum based catalysts are used on a support containing a zeolite between 260° C. and 350° C.

The preferred operating conditions in which this treatment step for the gasoline takes place are as follows: the temperature is in the range 70° C. to 350° C., preferably in the range 80° C. to 300° C., and the partial pressure of hydrogen is in the range 0.01 to 7 MPa, preferably in the range 0.5 to 5 MPa. The space velocity is in the range 0.2 to 10 litres of liquid hydrocarbons per litre of catalyst per hour, preferably 0.5 to 5 litres of liquid hydrocarbons per litre of catalyst per hour. The hydrogen/feed mole ratio at the reactor inlet is generally more than 0.01, preferably in the range 0.01 to 50, more preferably in the range 0.06 to 20.

A particularly suitable process for isomerising paraffins is that described in EP-A-0 750 941.

The isomerised effluent or the mixture of said effluent with the stream containing separated isoparaffins is then sent to the gasoline pool if the octane number has been sufficiently improved. In the contrasting case, at least a portion of the isomerised effluent is recycled to at least one of the following steps: c) isomerisation, and/or b) isoparaffin separation, and/or to a) conversion-hydroisomerisation.

Step b'): Catalytic Hydrodewaxing

Again with the aim of producing oils, at least a portion of the effluent from step a), which effluent has possibly undergone the separation and/or treatment steps described above, then undergoes a catalytic dewaxing step in the presence of hydrogen and a hydrodewaxing catalyst comprising an acidic function, a metallic hydro-dehydrogenating function and at least one matrix.

It should be noted that compounds boiling above at least 340° C. will always undergo catalytic dewaxing.

The Catalyst

The acid function is provided by at least one molecular sieve, preferably a molecular sieve with a microporous system having at least one principal channel type with openings formed by rings containing 10 or 9 T atoms. The T atoms are tetrahedral constituent atoms of the molecular sieve and can be at least one of the elements contained in the following set of atoms: (Si, Al, P, B, Ti, Fe, Ga). Atoms T, defined above, alternate with an equal number of oxygen atoms in the constituent rings of the channel openings. Thus it can equally be said that the openings are formed from rings containing 10 or 9 oxygen atoms or formed by rings containing 10 or 9 T atoms.

The molecular sieve forming part of the composition of the hydrodewaxing catalyst can also include other channel types but with openings formed from rings containing less than 10 T atoms or oxygen atoms.

The molecular sieve forming part of the preferred catalyst composition also has a bridging distance, the distance between two pore openings as defined above, which is at most 0.75 nm (1 nm=$10^{-9}$ m), preferably in the range 0.50 nm to 0.75 nm, more preferably in the range 0.52 nm to 0.73 nm; such sieves can produce good catalytic performances in the hydrodewaxing step.

The bridging distance is measured using a molecular modelling tool such as Hyperchem or Biosym, which enables the surface of the molecular sieves under consideration to be constructed using the ionic radii of the elements present in the sieve framework, to measure the bridging distance.

The preferred catalyst which is suitable for this process is characterized by a catalytic test known as a standard pure n-decane transformation test which is carried out at a partial pressure of 450 kPa of hydrogen and a partial pressure of n-$C_{10}$ of 1.2 kPa, giving a total pressure of 451.2 kPa in a fixed bed with a constant n-$C_{10}$ flow rate of 9.5 ml/h, a total flow rate of 3.6 l/h and a catalyst mass of 0.2 g. The reaction is carried out in upflow mode. The degree of conversion is adjusted by the temperature at which the reaction is carried out. The test catalyst is constituted by pelletised pure zeolite and 0.5% by weight of platinum.

In the presence of a molecular sieve and a hydro-dehydrogenating function, n-decane undergoes hydroisomerisation reactions which produce isomerised products containing 10 carbon atoms, and hydrocracking reactions leading to the formation of products containing less than 10 carbon atoms.

Under these conditions, a molecular sieve used in the hydrodewaxing step of the invention must have the physico-chemical characteristics described above and lead, for a yield of isomerised n-$C_{10}$ products of the order of 5% by weight (the degree of conversion is regulated by the temperature), to a 2-methylnonane/5-methylnonane ratio of more than 5 and preferably more than 7.

The use of molecular sieves selected in this manner and under the conditions described above selected from the numerous molecular sieves already in existence enables products with a low pour point and a high viscosity index to be produced in good yields in the process of the invention.

Examples of molecular sieves which can be used in the preferred composition of the catalytic hydrodewaxing catalyst are the following zeolites: ferrierite, NU-10, EU-13, EU-1.

Preferably, the molecular sieves used in the composition of the hydrodewaxing catalyst are included in the set formed by ferrierite and EU-1 zeolite.

In general, the hydrodewaxing catalyst comprises a zeolite selected from the group formed by NU-10, EU-1, EU-13, ferrierite, ZSM-22, Theta-1, ZSM-50, ZSM-23, NU-23, ZSM-35, ZSM-38, ISI-1, KZ-2, ISI-4, KZ-1.

The quantity of molecular sieve in the hydrodewaxing catalyst is in the range 1% to 90% by weight, preferably in the range 5% to 90% by weight and more preferably in the range 10% to 85% by weight.

Non limiting examples of matrices used to produce the catalyst are alumina gel, alumina, magnesia, amorphous silica-alumina and mixtures thereof Techniques such as extrusion, pelletisation or bowl granulation can be used to carry out the forming operation.

The catalyst also comprises a hydro-dehydrogenating function ensured, for example, by at least one group VIII element and preferably at least one noble element selected from the group formed by platinum and palladium. The amount of non noble group VIII metal with respect to the final catalyst is in the range 1% to 40%, preferably in the range 10% to 30%. In this case, the non noble metal is often associated with at least one group VIB metal (preferably Mo and W). If at least one noble group VIII metal is used, the quantity with respect to the final catalyst is less than 5% by weight, preferably less than 3% and more preferably less than 1.5%.

When using noble group VIII metals, the platinum and/or palladium is/are preferably localised on the matrix.

The hydrodewaxing catalyst of the invention can also contain 0 to 20%, preferably 0 to 10% by weight (expressed as the oxides) of phosphorous. The combination of group VIB metal(s) and/or group VIII metal(s) with phosphorous is particularly advantageous.

The Treatment

The residue obtained from step a) and the distillation step (which has also separated at least one gasoline cut) and which is treated in this hydrodewaxing step b') has the following characteristics: it has an initial boiling point of more than 340° C. and preferably more than 370° C., a pour point of at least 15° C., a viscosity index of 35 to 165 (before dewaxing), preferably at least 110 and more preferably less than 150, a viscosity at 100° C. of 3 cSt ($mm^2/s$) or more, an aromatic compound content of 10% by weight, a nitrogen content of less than 10 ppm by weight, and a sulphur content of less than 50 ppm by weight or, preferably, 10 ppm by weight.

The operating conditions for the catalytic step of the process of the invention are as follows:

- the reaction temperature is in the range 200° C. to 500° C., preferably in the range 250° C. to 470° C., advantageously 270–430° C.;
- the pressure is in the range 0.1 to 25 MPa ($10^6$ Pa), preferably in the range 1.0 to 20 MPa;
- the hourly space velocity (HSV, expressed as the volume of feed injected per unit volume of catalyst per hour) is in the range from about 0.05 to about 50, preferably in the range about 0.1 to about 20 $h^{-1}$, more preferably in the range 0.2 to 10 $h^{-1}$.

They are selected so as to produce the desired pour point.

The feed and catalyst are brought into contact in the presence of hydrogen. The amount of hydrogen used, expressed in litres of hydrogen per litre of feed, is in the range 50 to about 2000 litres of hydrogen per litre of feed, preferably in the range 100 to 1500 litres of hydrogen per litre of feed.

Effluent Obtained

The effluent at the outlet from hydrodewaxing step b') is sent to the distillation train which preferably integrates atmospheric distillation and vacuum distillation, with the aim of separating the conversion products with a boiling point of less than 340° C. and preferably less than 370° C. (and including those formed during the catalytic hydrodewaxing step), and separating the fraction which constitutes the base stock and for which the initial boiling point is more than at least 340° C. and preferably 370° C. or more.

Further, this vacuum distillation section can separate different grades of oils.

At least a portion of the fractions separated from the oil (i.e., end point at most 340° C.) can advantageously be recycled to the distillation step located between steps a) and b) and which treats the effluent from step a). Advantageously, at least a portion of the gasoline fraction obtained during separation of the oil is recycled to step b) for separating isoparaffins.

Preferably, before being distilled, at least a portion and preferably the whole of the effluent from the outlet from catalytic hydrodewaxing step b') is sent over a hydrofinishing catalyst in the presence of hydrogen to carry out deep hydrogenation of the aromatic compounds which have a deleterious effect on the stability of the oils and distillates. However, the acidity of the catalyst must be sufficiently weak so as not to lead to the formation of cracking products with a boiling point of less than 340° C. so as not to degrade the final yields, in particular the oil yields.

The catalyst used in this step comprises at least one group VII metal and/or at least one element from group VIB of the periodic table. Strong metallic functions: platinum and/or palladium, or nickel-tungsten, nickel-molybdenum combinations, are advantageously used to carry out deep hydrogenation of the aromatic compounds.

These metals are deposited and dispersed on an amorphous or crystalline oxide type support, such as aluminas, silicas and silica-aluminas.

The hydrofinishing (HDF) catalyst can also contain at least one element from group VIIA of the periodic table. Preferably, these catalysts contain fluorine and/or chlorine.

The metal contents are in the range 10% to 30% in the case of non noble metals and less than 2%, preferably in the range 0.1% to 1.5%, more preferably in the range 0.1% to 1.0% in the case of noble metals.

The total quantity of halogen is in the range 0.02% to 30% by weight, advantageously 0.01% to 15%, or 0.01% to 10%, preferably 0.01% to 5%.

Catalysts containing at least one noble group VIII metal (for example platinum) and at least one halogen (chlorine and/or fluorine), a combination of chlorine and fluorine being preferred, can be cited as catalysts suitable for use in this hydrorefining step, and lead to excellent performances in particular for the production of medicinal oils.

The following conditions are employed for the hydrofinishing step of the process of the invention:

- the reaction temperature is in the range 180° C. to 400° C., preferably in the range 210° C. to 350° C., advantageously 230–320° C.;
- the pressure is in the range 0.1 to 25 MPa ($10^6$ Pa), preferably in the range 1.0 to 20 MPa;
- the hourly space velocity (HSV, expressed as the volume of feed injected per unit volume of catalyst per hour) is in the range from about 0.05 to about 100, preferably in the range about 0.1 to about 30 $h^{-1}$.

Contact between the feed and the catalyst is carried out in the presence of hydrogen. The amount of hydrogen used and expressed in litres of hydrogen per litre of feed is in the range 50 to about 2000 litres of hydrogen per litre of feed, preferably in the range 100 to 1500 litres of hydrogen per litre of feed.

Advantageously, the temperature of the HDF step is lower than the temperature of the catalytic hydrodewaxing step (CHDW). The difference $T_{CHDW}-T_{HDF}$ is generally in the range 20° C. to 200° C., preferably in the range 30° C. to 100° C. The effluent at the outlet from the HDF step is sent to the distillation train.

The Products

The base stock obtained using this process has a pour point of less than −10° C., a VI of more than 95, preferably more than 110 and more preferably more than 120, a viscosity of at least 3.0 cSt at 100° C., an ASTM colour of less than 1 and a UV stability such that the increase in the ASTM colour is in the range 0 to 4, preferably in the range 0.5 to 2.5.

The UV stability test, adapted from the ASTM D925-55 and D1148-55 procedures, is a rapid method for comparing the stability of lubricating oils exposed to a source of ultraviolet radiation. The test chamber is constituted by a metal chamber provided with a rotary plate which receives the oil samples. A bulb producing the same ultraviolet radiation as that of solar radiation placed in the top of the test chamber is directed downwards onto the samples. The samples include a standard oil with known UV characteristics. The ASTM D1500 colour of the samples is determined at t=0 then after 45 h of exposure at 55° C. The results for the standard sample and the test samples are transcribed as follows:

a) initial ASTM D1500 colour;

b) final ASTM D1500 colour;

c) increase in colour;

d) cloudiness;

e) precipitate.

The middle distillates obtained have improved pour points (at most −20° C.), a cetane index of more than 50, and even more than 52.

BRIEF DESCRIPTION OF THE DRAWING

In FIG. 1, the feed enters via a line (1) into a hydrotreatment zone (2) (which can be composed of one or more reactors, and comprises one or more catalytic beds of one or more catalysts) into which the hydrogen enters (for example via line (3)) and where the hydrotreatment step is carried out.

Figure 1:
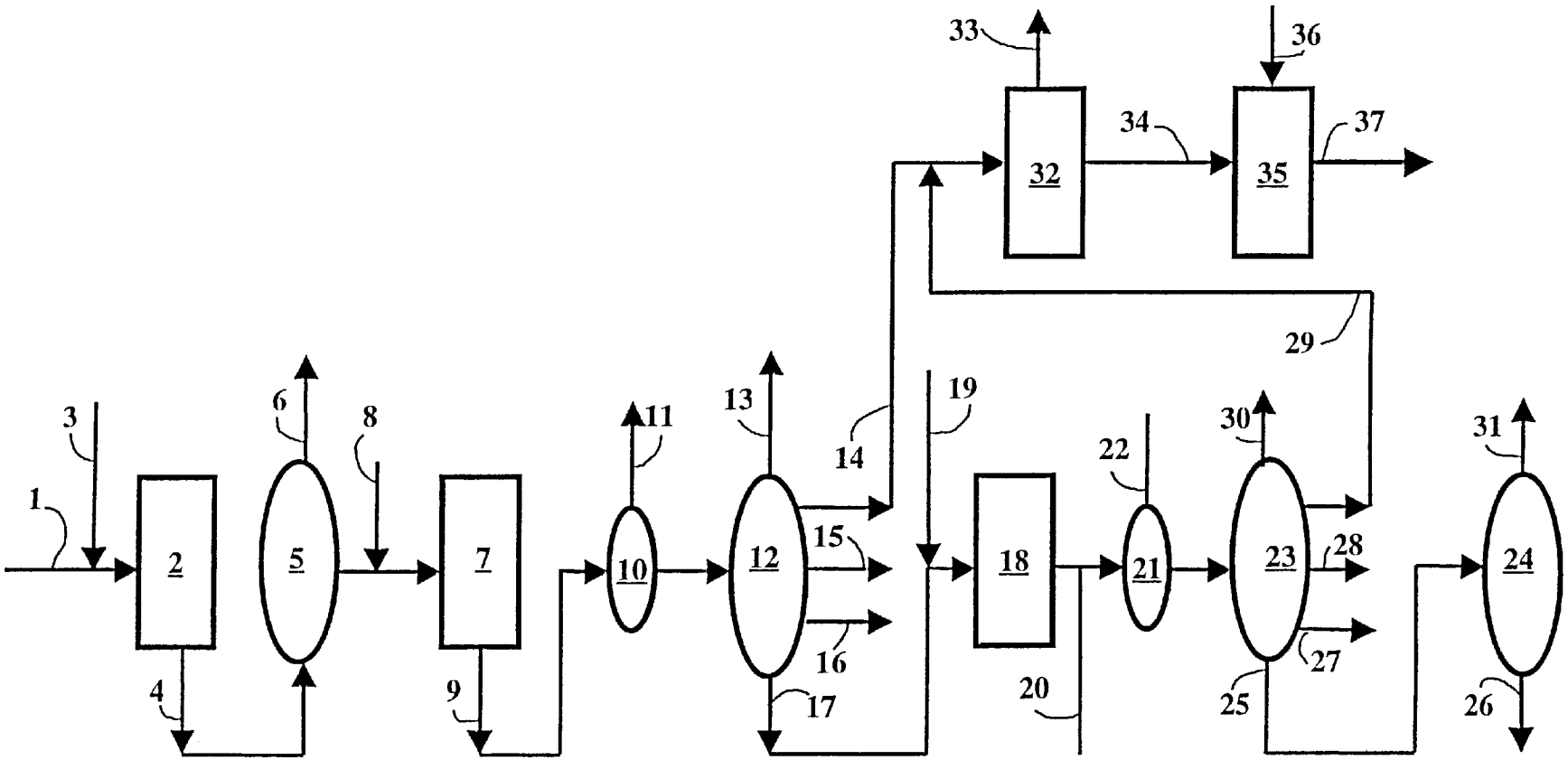
FIG. 1 represents treatment of a feed from the Fischer-Tropsch process.

The hydrotreated feed is transferred via line (4) into a hydroisomerisation zone (7) (which can be composed of one or more reactors, and comprises one or more catalytic beds of one or more catalysts) where hydroisomerisation step a) is carried out in the presence of hydrogen. Hydrogen can be supplied via a line (8).

In this figure, before being introduced into zone (7), the feed to be hydroisomerised is freed of a large portion of its water in drum (5), the water leaving via line (6), possibly along with ammonia and hydrogen sulphide $H_2S$, when the feed entering via line 1 contains sulphur and nitrogen.

The effluent leaving zone (7) is sent via a line (9) to a drum (10) to separate hydrogen via a line (11); the effluent is then distilled under atmospheric pressure in a column (12) from which a light fraction containing compounds containing at most 4 carbon atoms and those boiling below this ($NH_3$, $H_2S$, $C_1$, $C_2$, $C_3$, and $C_4$) is extracted overhead via a line (13).

At least one gasoline fraction (14) and at least one middle distillate fraction (kerosine (15) and gas oil (16), for example) are also obtained.

A fraction containing compounds with a boiling point of more than at least 340° C. is obtained from the bottom of the column. This fraction is evacuated via line (17) to catalytic dewaxing zone (18).

Catalytic dewaxing zone (18) (comprising one or more reactors, one or more catalytic beds of one or more catalysts) also receives hydrogen via a line (19) to carry out step b) of the process.

The effluent leaving via line (20) is separated in a distillation train comprising, in addition to drum (21) for separating hydrogen via a line (22), an atmospheric distillation column (23) and a vacuum column (24) which treats the atmospheric residue transferred via line (25), the residue having an initial boiling point of more than 340° C.

The products from the distillations are an oil fraction (line 26), and lower boiling fractions such as gas oil (line 27), kerosine (line 28), gasoline (line 29), light gases are eliminated via line (30) of the atmospheric column and via line (31) of the vacuum distillation column.

The effluent leaving via line (20) can also advantageously be sent to a hydrofinishing zone (not shown) (comprising one or more reactors, one or more catalytic beds of one or more catalysts) before being injected into the separation train. Hydrogen can be added to this zone if necessary. The departing effluent is then transferred to drum (21) and the distillation train described above.

The gasoline fraction leaving via line (14) is sent to an isoparaffin separation zone (32) which isoparaffins are extracted via line (33). This stream can be directly sent to the gasoline pool or it can undergo a second separation step producing a stream of multibranched (di- and more) paraffins sent to the gasoline pool, and a stream which contain monobranched paraffins and can be recycled to step c) carried out in zone (35). The residual effluent leaving via line (34) and containing normal paraffins and possibly monobranched paraffins is introduced into a zone (35) for isomerising paraffins supplied with hydrogen via line (36). The isomerised effluent leaves via line (37).

In order not to complicate the figure, the hydrogen recycle has not been shown, either from drum (10) to the hydrotreatment and/or hydroisomerisation step, and/or from drum (21) to the dewaxing and/or hydrofinishing step and/or paraffin isomerisation step. Recycles of non transformed fluids have also not been shown, except the recycle of the gasoline leaving via line (29) to isoparaffin separation zone (32).

EXAMPLE

Preparation of Conversion-hydroisomerisation Catalyst A of Step a)

The support was a silica-alumina used in the form of extrudates. It contained 29.3% by weight of silica $SiO_2$ and 70.7% by weight of alumina $Al_2O_3$. Before adding any noble metal, the specific surface area of the silica-alumina was 330 $m^2/g$ and its total pore volume was 0.87 $cm^3/g$.

Corresponding catalyst A was obtained after impregnating the noble metal onto the support. A platinum salt $Pt(NH_3)_4Cl_2$ was dissolved in a volume of solution corresponding to the total pore volume to be impregated. The solid was then calcined for 2 hours in moist air (partial pressure of $H_2O$= 0.15 bars) at 500° C. The platinum content was 0.60% by weight. The pore volume, measured on the catalyst, was 0.82 $cm^3/g$. The BET surface area, measured on the catalyst, was 287 $m^2/g$ and the mean pore diameter, measured on the catalyst, was 7 mm. The pore volume corresponding to pores with a pore diameter in the range 4 nm to 10 nm was 0.37 $cm^3/g$, i.e., 44% of the total pore volume. The dispersion of the platinum measured by $H_2/O_2$ titration was 19%. The results obtained by the local analyses of transmission electron microscope exposures indicated to us a noble metal particle distribution wherein the fraction of less than 2 nm, representing traces of Pt, was at most 2% by weight of metal.

Figure 2:
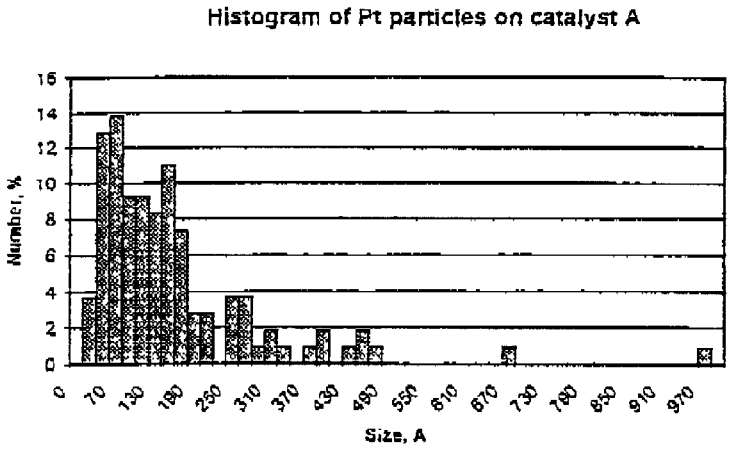
FIG. 2 is a histrogram of Pt particles on a catalyst of the invention.

FIG. 2 is a histogram of the fraction of particles with a size of more than 2 nm. This histogram shows that particles with a size in the range 13±6 nm represents at least 70% by number of the particles.

Evaluation of Catalyst A for Conversion-hydroisomerisation of a Fischer-Tropsch Feed Followed by Separation and Catalytic Dewaxing (Test 1)

The catalyst prepared as described in Example 1 was used to hydroisomerise a paraffin feed from the Fischer-Tropsch synthesis with the aim of producing oils. In order to be able to directly use the hydroisomerisation catalyst, the feed was first hydrotreated and the oxygen content brought to below 0.1% by weight. The principal characteristics of the hydrotreated feed were as follows:

| | |
|---|---|
| initial point | 170° C. |
| 10% point | 197° C. |
| 50% point | 350° C. |
| 90% point | 537° C. |
| End point | 674° C. |
| $380^+$ (weight %) | 42 |
| Pour point | +73° C. |
| Density (20/4) | 0.787 |

The catalytic test unit comprised a single fixed bed reactor used in up-flow mode, into which 80 ml of catalyst was introduced. The catalyst was then placed under a pure hydrogen atmosphere at a pressure of 10 MPa to reduce the platinum oxide to metallic platinum, then finally the feed was injected. The total pressure was 10 MPa; the hydrogen flow rate was 1000 litres of gaseous hydrogen per litre of injected feed; the hourly space velocity was 1 $h^{-1}$; and the reaction temperature was 350° C. After reacting, the effluents were fractionated into light products (gasoline, IP—150° C.), middle distillates (150–380° C.), and residue ($380^{+\circ}$ C.).

The residue was then dewaxed in a second reactor in upflow mode into which 80 ml of a catalyst containing 80% by weight of a ferrierite zeolite with a Si/Al ratio of 10.2 and 20% of alumina as well as 0.6% by weight of Pt was introduced. The catalyst was placed in a pure hydrogen atmosphere at a pressure of 10 MPa to reduce the platinum oxide to metallic platinum then finally the feed was injected. The total pressure was 10 MPa; the hydrogen flow rate was 1000 litres of gaseous hydrogen per litre of injected feed; the hourly space velocity was 2 $h^{-1}$ and the reaction temperature was 350° C. After reacting, the effluents were fractionated into light products (gasoline IP—150° C., middle distillates (150–380° C.) and residue ($380^{+\circ}$ C.). The characteristics of the oil obtained were measured.

The table below shows the yields for the different fractions and the characteristics of the oils obtained directly with the feed and with the effluents hydroisomerised using catalyst A.

| | Hydrotreated feed | Hydroisomerised and dewaxed effluent |
|---|---|---|
| Hydroisomerisation catalyst | / | A |
| Dewaxing | Solvent, −20° C. | Catalytic dewaxing |
| Density of effluents at 15° C. | 0.790 | 0.779 |
| Wt % $380^-$/effluents | 58 | 69 |
| Wt % $380^+$/effluents | 42 | 31 |

-continued

| | Hydrotreated feed | Hydroisomerised and dewaxed effluent |
|---|---|---|
| | Quality of 380⁺ residue | |
| Dewaxing yield (wt %) | 6 | 59 |
| Oil/feed yield | 2.5 | 18.3 |
| | Quality of oil | |
| VI (viscosity index) | 143 | 140 |
| | Cut distribution | |
| IP–150 | 0 | 12 |
| 150–380 | 58 | 57 |
| $380^+$ | 42 | 31 |
| Net conversion of $380^-$ (%) | / | 26.2 |

* The solvent used was methylisobutylketone.

It can clearly be seen that the feed which had not been hydroisomerised and solvent dewaxed at −20° C. had an extremely low yield of oil while after the hydroisomerisation and catalytic dewaxing operation, the oil yield was higher.

Evaluation of Catalyst A During a Test Carried Out to Produce Both Middle Distillates and Gasoline (test 2)

The catalyst prepared as described in Example 1 was used to hydroisomerise a paraffin feed from the Fischer-Tropsch synthesis with the aim of producing middle distillates (kerosine+gas oil) and gasolines. In order to be able to directly use the hydroisomerisation catalyst, the feed was first hydrotreated and the oxygen content brought to below 0.1% by weight. The principal characteristics of the hydrotreated feed were as follows:

| | |
|---|---|
| initial point | 170° C. |
| 10% point | 197° C. |
| 50% point | 350° C. |
| 90% point | 537° C. |
| End point | 674° C. |
| $380^+$ (weight %) | 42 |
| Pour point | +73° C. |
| Density (20/4) | 0.787 |

The catalytic test unit comprised a single fixed bed reactor used in up-flow mode, into which 80 ml of catalyst was introduced. The catalyst was then placed under a pure hydrogen atmosphere at a pressure of 12 MPa to reduce the platinum oxide to metallic platinum, then finally the feed was injected. The total pressure was 12 MPa; the hydrogen flow rate was 1000 litres of gaseous hydrogen per litre of injected feed; the hourly space velocity was 1 $h^{-1}$; and the reaction temperature was 365° C. After reacting, the effluents were fractionated into light products (gasoline, IP—150° C.), kerosine (150–250° C.), gas oil (250–380° C.) and residue ($380^{+}$° C.).

The yields and characteristics of the different fractions from the effluents hydroisomerised on catalyst A are reported below.

| Cut distribution: (weight %) | |
|---|---|
| IP–150° C. | 17 |
| 150–250° C. | 33 |
| 250–380° C. | 47 |
| $380^+$ | 3 |

IP=initial boiling point.

| Product quality: | |
|---|---|
| IP–150° C. | MON = 43 |
| 150–250° C. | Smoke point: 53 mm<br>Freezing point: −41° C. |
| 250–380° C. | Cetane index: >70<br>Pour point: −25° C. |

Catalyst A can produce good yields for middle distillates (80% by weight) from a paraffin feed from the Fischer-Tropsch synthesis and the middle distillates obtained are of very high quality.

Improvement of the Octane Number of the Gasoline Cut

The IP—150° C. gasoline cut obtained in test 2 was treated with a molecular sieve such as silicalite to separate, by adsorption, n-paraffins and mono-branched paraffins from iso-paraffins. The separated isoparaffins were sent directly to the gasoline pool while the residual gasoline containing the n-paraffins and monobranched paraffins was treated in the presence of hydrogen and a catalyst comprising 40% by weight of beta zeolite with an Si/Al atomic ratio of 15, and 60% by weight of alumina. Further, this catalyst comprised 0.6% by weight of platinum with respect to the alumina+beta zeolite ensemble. The $H_2$/HC mole ratio used to carry out hydroisomerisation of the normal paraffins, from the gasoline cut, was 3, the total pressure was 30 bars and the HSV (weight of feed injected per unit mass of catalyst per hour) was 0.9 $h^{-1}$. The gasoline fraction recovered and thus containing isoparaffins produced during the catalytic hydroisomerisation reaction was then mixed with previously separated isoparaffins. The motor number of the gasoline pool recovered was 68, i.e., much higher than the initial motor number.

What is claimed is:

1. A process for producing gasoline with an improved octane number from a hydrocarbon containing feed, comprising the following successive steps:

(a) converting the feed with simultaneous hydroisomerisation of the paraffins of the feed, said feed having a sulphur content of less than 1000 ppm by weight, a nitrogen content of less than 200 ppm by weight, a metals content of less than 50 ppm by weight, an oxygen content of at most 0.2% by weight, said step being carried out at a temperature of 200–500° C., at a pressure of 5–25 MPa, with a space velocity of 0.1–5 $h^{-1}$, in the presence of hydrogen, and in the presence of a catalyst containing at least one noble metal deposited on an amorphous acidic support, and separating at least one gasoline cut and at least one residue containing compounds with a boiling point of more than at least 340° C. from the effluent from step a);

(b) separating iso-paraffins from said gasoline cut and producing an effluent containing normal paraffins;

(c) isomerising the paraffins in at least a portion of said effluent from step b) by contact with a catalyst containing at lease one hydrodehydrogenating metal and at least one acidic solid, in the presence of hydrogen, so as to produce an effluent charged with iso-paraffins with an improved octane number;

(b) catalytic dewaxing of said residue using a catalyst comprising at least one molecular sieve the microporous system of which exhibits at least one principal channel with pore openings having 9 to 10 T atoms, T being Si, Al, P, B, Ti, or Ga, alternating with an equal number of oxygen atoms, the distance between two accessible pore openings having 9 or 10 T atoms being at most 0.75 nm, an said sieve having a 2-methylononane/5-methylononane ratio of more than 5 in the n-decane test.

2. A process according to claim 1, in which step c) is carried out at 70–350° C. at 0.1–7 MPa with a space velocity of 0.2–10 liters of liquid hydrocarbons per liter of catalyst per hour, and with an $H_2$/feed mole ratio of more than 0.01.

3. A process according to claim 1, in which the catalyst for step c) comprises at least one acidic solid selected from the group consisting of halogenated aluminas, zeolites, non zeolitic molecular sieves and clays, said catalyst also comprising at least one hydrodehydrogenating group VIII metal.

4. A process according to claim 1, in which the acidic solid of step c) is selected from mordenite, mazzite, ZSM-22, beta zeolite, SAPO-11, SAPO-41, and bridged 2:1 dioctahedral phyllosilicates.

5. A process according to claim 4, in which the hydrodehydrogenating metal in the catalyst for step c) is platinum.

6. A process according to claim 1, in which the catalyst used for step a) is essentially constituted by 0.05% to 10% by weight of at least one noble metal from group VIII deposited on an amorphous silica-alumina support with a BET specific surface area of 100–500 $m^2/g$, and the catalyst exhibits:

a mean mesopore diameter in the range 1–12 nm;

a pore volume of pores with a diameter in the range from the mean diameter as defined above less 3 nm to the mean diameter as defined above plus 3 nm of more than 40% of the total pore volume;

a dispersion of noble metal in the range 20–100%;

a noble metal distribution coefficient of more than 0.1.

7. A process according to claim 6, in which the support contains 5–70% by weight of silica.

8. A process according to claim 1, in which the catalyst of step (a) exhibits a dispersion of the noble metal in of less than 20%.

9. A process according to claim 8, wherein in the catalyst of step a), noble metal particles with a size of less than 2 nm represents at most 2% by weight of the noble metal deposited on the catalyst.

10. A process according to claim 8 wherein the catalyst of step (a) comprises a support selected from the group consisting of at least one of a silica-alumina, a halogenated alumina, an alumina doped with silica, an alumina-titanium oxide mixture, a sulphated zirconia, and a zirconia doped with tungsten.

11. A process according to claim 10, wherein the support further comprises at least one amorphous matrix selected from the group consisting of alumina, titanium oxide, silica, boron oxide, magnesia, zirconia and clay.

12. A process according to claim 11, wherein the support constituted by an amorphous silica-alumina.

13. A process according to claim 1, characterized in that the noble metal of the catalyst for step a) is platinum or palladium.

14. A process according to claim 1, in which the separating of step b) is carried out with an adsorbent and/or a membrane.

15. A process according to claim 1, in which the molecular sieve of step (b') is a zeolite selected from the group consisting of NU-10, EU-1, EU-13, ferrierite, ZSM-22, theta-1, ZSM-50, ZSM-23, NU-23, ZSM-35, ZSM-38, ISI-1, KZ-2, ISI-4, KZ-1.

16. A process according to claim 1, further comprising subjecting effluent from step b') to a hydrofinishing step before being distilled.

17. A process according to claim 1, in which the catalytic dewaxing is carried out at 200–500° C. at a pressure of 0.1–25 MPa, at an hourly space velocity of 0.05–50 $h^{-1}$ and in the presence of 50–2000 1 of $H_2$ per liter of feed.

18. A process according to claim 1, in which effluent from the catalytic dewaxing step b') is distilled and at least a portion of the gasoline fraction obtained is recycled to the isoparaffin separation step b).

19. A process according to claim 1, in which at least a portion of isomerised effluent from step c) is recycled to at least one of the following steps: c) paraffin isomerisation; b) isoparaffin separation or a) conversion-hydroisomerisation.

20. A process according to claim 18, in which at least a portion of isomerised effluent from step c) is recycled to at least one of the following steps: c) paraffin isomerisation; b) isoparaffin separation or a) conversion-hydroisomerisation.

21. A process according to claim 3, in which the catalyst used for step a) is essentially constituted by 0.05% to 10% by weight of at least one noble metal from group VIII deposited on an amorphous silica-alumina support with a BET specific surface area of 100–500 $m^2/g$, and the catalyst exhibits:

a mean mesopore diameter in the range 1–12 nm;

a pore volume of pores with a diameter in the range from the mean diameter as defined above less 3 nm to the mean diameter as defined above plus 3 nm of more than 40% of the total pore volume;

a dispersion of noble metal in the range 20–100% a nobel metal distribution coefficient of more than 0.1.

22. A process according to claim 4, in which the catalyst used for step a) is essentially constituted by 0.05% to 10% by weight of at least one noble metal from group VIII deposited on an amorphous silica-alumina support with a BET specific surface area of 100–500 $m^2/g$, and the catalyst exhibits:

a mean mesopore diameter in the range 1–12 nm;

a pore volume of pores with a diameter in the range from the mean diameter as defined above less 3 nm to the mean diameter as defined above plus 3 nm of more than 40% of the total pore volume;

a dispersion of noble metal in the range 20–100% a nobel metal distribution coefficient of more than 0.1.

23. A process according to claim 6, wherein the noble metal of the catalyst for step a) is platinum or palladium.

24. A process according to claim 12, wherein the noble metal of the catalyst for step a) is platinum or palladium.

* * * * *